US006869157B2

(12) United States Patent
Miyakoshi et al.

(10) Patent No.: US 6,869,157 B2
(45) Date of Patent: Mar. 22, 2005

(54) METHOD OF DRIVING AND CONTROLLING INK JET PRINT HEAD, INK JET PRINT HEAD, AND INK JET PRINTER

(75) Inventors: Toshimori Miyakoshi, Kanagawa (JP); Shuichi Murakami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/103,970

(22) Filed: Mar. 25, 2002

(65) Prior Publication Data

US 2002/0149637 A1 Oct. 17, 2002

(30) Foreign Application Priority Data

Mar. 26, 2001 (JP) ..... 2001-088453

(51) Int. Cl.[7] ..... B41J 29/38

(52) U.S. Cl. ..... 347/9; 347/11; 347/16; 347/14

(58) Field of Search ..... 347/9, 14, 16, 347/11, 60

(56) References Cited

U.S. PATENT DOCUMENTS 5,751,302 A * 5/1998 Rezanka ..... 347/9
5,774,137 A * 6/1998 Yoshida ..... 347/14
5,880,751 A * 3/1999 Nishikori et al. ..... 347/14
5,943,069 A * 8/1999 Kamiyama et al. ..... 347/14
5,943,070 A 8/1999 Kamiyama et al. ..... 347/19
6,024,439 A * 2/2000 Sueoka ..... 347/50
6,302,507 B1 * 10/2001 Prakash et al. ..... 347/14
6,439,696 B1 * 8/2002 Murakami et al. ..... 347/56

FOREIGN PATENT DOCUMENTS

JP 4-76077 3/1995

* cited by examiner

*Primary Examiner*—Stephen D. Meier
*Assistant Examiner*—Lam Nguyen
(74) *Attorney, Agent, or Firm*—Fitzpatrick, Cella, Harper & Scinto

(57) ABSTRACT

An increase in variation in resistance value resulting from a reduction in thickness of heaters is dealt with without increasing the manufacture costs of the print head, by allowing smaller ink droplets to be efficiently ejected. A setting for a pulse voltage essentially varied depending on the ejection threshold energy of the head is employed so that optimum drive power conditions can be reasonably set over a range of varying resistance values resulting from differences among manufactured print heads. This provides a print head and a printing apparatus which can deal with an increase in differences among manufactured heads by allowing smaller ink droplets to be efficiently ejected without reducing the yield of manufactured print heads.

19 Claims, 14 Drawing Sheets

| RANK | HEATER RESISTANCE VALUE (=SHEET RESISTANCE VALUE) [Ω] | PULSE WIDTH [μsec] TRANSISTOR ON RESISTANCE VALUE [Ω] | | | PULSE VOLTAGE [V] TRANSISTOR ON RESISTANCE VALUE [Ω] | | |
|---|---|---|---|---|---|---|---|
| | | 10 | 17 | 24 | 10 | 17 | 24 |
| min. | 140 | 1.03 | 1.11 | 1.21 | 14.0 | 14.0 | 14.0 |
| ⋮ | ⋮ | ⋮ | ⋮ | ⋮ | ⋮ | ⋮ | ⋮ |
| CENTER | 200 | 1.36 | 1.46 | 1.54 | 14.0 | 14.0 | 14.0 |
| ⋮ | ⋮ | ⋮ | ⋮ | ⋮ | ⋮ | ⋮ | ⋮ |
| max. | 260 | 1.70 | 1.79 | 1.88 | 14.0 | 14.0 | 14.0 |

| RANK | HEATER RESISTANCE VALUE (=SHEET RESISTANCE VALUE) [Ω] | PULSE WIDTH[μsec] | | | PULSE VOLTAGE[V] | | |
|---|---|---|---|---|---|---|---|
| | | TRANSISTOR ON RESISTANCE VALUE[Ω] | | | TRANSISTOR ON RESISTANCE VALUE[Ω] | | |
| | | 10 | 17 | 24 | 10 | 17 | 24 |
| min. | 45 | 0.82 | 1.01 | 1.22 | 11.0 | 11.0 | 11.0 |
| ⋮ | ⋮ | ⋮ | ⋮ | ⋮ | ⋮ | ⋮ | ⋮ |
| CENTER | 50 | 0.86 | 1.05 | 1.26 | 11.0 | 11.0 | 11.0 |
| ⋮ | ⋮ | ⋮ | ⋮ | ⋮ | ⋮ | ⋮ | ⋮ |
| max. | 55 | 0.90 | 1.09 | 1.29 | 11.0 | 11.0 | 11.0 |

FIG.2

| RANK | HEATER RESISTANCE VALUE (=SHEET RESISTANCE VALUE) [Ω] | PULSE WIDTH[μsec] | | | PULSE VOLTAGE[V] | | |
|---|---|---|---|---|---|---|---|
| | | TRANSISTOR ON RESISTANCE VALUE[Ω] | | | TRANSISTOR ON RESISTANCE VALUE[Ω] | | |
| | | 10 | 17 | 24 | 10 | 17 | 24 |
| min. | 140 | 1.03 | 1.11 | 1.21 | 14.0 | 14.0 | 14.0 |
| ⋮ | ⋮ | ⋮ | ⋮ | ⋮ | ⋮ | ⋮ | ⋮ |
| CENTER | 200 | 1.36 | 1.46 | 1.54 | 14.0 | 14.0 | 14.0 |
| ⋮ | ⋮ | ⋮ | ⋮ | ⋮ | ⋮ | ⋮ | ⋮ |
| max. | 260 | 1.70 | 1.79 | 1.88 | 14.0 | 14.0 | 14.0 |

FIG.11

| RANK | HEATER RESISTANCE VALUE (=SHEET RESISTANCE VALUE) [Ω] | PULSE WIDTH[μsec] | | | PULSE VOLTAGE[V] | | |
|---|---|---|---|---|---|---|---|
| | | TRANSISTOR ON RESISTANCE VALUE[Ω] | | | TRANSISTOR ON RESISTANCE VALUE[Ω] | | |
| | | 10 | 17 | 24 | 10 | 17 | 24 |
| min. | 140 | 1.05 | 1.05 | 1.05 | 13.8 | 14.4 | 15.1 |
| ⋮ | ⋮ | ⋮ | ⋮ | ⋮ | ⋮ | ⋮ | ⋮ |
| CENTER | 200 | 1.05 | 1.05 | 1.05 | 16.0 | 16.5 | 17.0 |
| ⋮ | ⋮ | ⋮ | ⋮ | ⋮ | ⋮ | ⋮ | ⋮ |
| max. | 260 | 1.05 | 1.05 | 1.05 | 17.9 | 18.3 | 18.8 |

FIG.12

| RANK | HEATER RESISTANCE VALUE (=SHEET RESISTANCE VALUE) [Ω] | PULSE WIDTH[μsec] | | | PULSE VOLTAGE[V] | | |
|---|---|---|---|---|---|---|---|
| | | TRANSISTOR ON RESISTANCE VALUE[Ω] | | | TRANSISTOR ON RESISTANCE VALUE[Ω] | | |
| | | 10 | 17 | 24 | 10 | 17 | 24 |
| min. | 140 | 0.95 | 1.00 | 1.05 | 14.5 | 14.8 | 15.1 |
| ⋮ | ⋮ | ⋮ | ⋮ | ⋮ | ⋮ | ⋮ | ⋮ |
| CENTER | 200 | 1.00 | 1.05 | 1.10 | 16.4 | 16.5 | 16.6 |
| ⋮ | ⋮ | ⋮ | ⋮ | ⋮ | ⋮ | ⋮ | ⋮ |
| max. | 260 | 1.05 | 1.10 | 1.15 | 17.9 | 17.9 | 17.9 |

FIG.13

METHOD OF DRIVING AND CONTROLLING INK JET PRINT HEAD, INK JET PRINT HEAD, AND INK JET PRINTER

This application is based on Patent Application No. 2001-088453 filed Mar. 26, 2001 in Japan, the content of which is incorporated hereinto by reference.

BACKGROUND OF THE INVENTION

1. Field of the Invention

The present invention relates to a method of driving and controlling an ink jet print head, an ink jet print head applied to this method, and a printing apparatus using this method. Specifically, the present invention relates to an ink jet print head and printing apparatus based on a thermal ink jet system in which heating resistance elements that generate heat in response to electric conduction are used to cause film boiling in ink so that growth and contraction of the resulting bubbles is used to eject the ink through nozzles.

2. Description of the Related Art

In recent years, ink jet printing systems have advanced rapidly because they can achieve high-density and high-definition printing at a high speed to promptly provide high-quality print matter and are suitable for multicolor applications and size reductions.

An example of a head for use in such an ink jet printing system is what is called a side shooter type ink jet print head constructed so that ink passages are bent toward the nozzles and a thermal operation portion is arranged in each bent portion and opposite the corresponding nozzle.

FIG. 1 shows an example of the construction of a side shooter type print head. This head has a plurality of nozzles 3001 arranged in zigzag configuration at the opposite sides of an ink supply port 3003 opened in a substrate 3005 composed of silicon, and heating resistance elements 3002 arranged on the substrate 3005 for each of the ink passages 3004 and used to eject ink droplets in order to generate thermal energy.

The heating resistance elements 3002 are each composed of a heater consisting mainly of HfB, TaN, TaAl, TaSiN, or the like, electrode wiring consisting of Al, AlCu, AlSi, or the like to supply power to the heater, and a protective film consisting of SiC, SiO, SiN, Ta, or the like to protect the heater and electrode wiring from ink (not shown).

The ink supply port 3003 is generally formed using a dicing process, a sand blast process, an anisotropic etching process, or the like. FIG. 1 shows the ink supply port 3003 formed by the anisotropic etching process, which has a high machining precision. The machining precision for the ink supply port 3003 is an important factor for manufacture of print heads. With a low machining precision, the ink passages 3004 have different distances from their ends located closer to the ink supply ports 3003 to the heaters, resulting in a variation in resistance of ink flow. As a result, the amount of ink ejected varies among the nozzles 3001, thereby reducing the grade of print images.

Further, the formation of the nozzles 3001 is roughly classified into a method of sticking and joining a film made of polyimide or the like and having nozzle openings already formed by a laser machining process, to the substrate 3005, or a method of coating the substrate 3005 with resin material or the like and then forming nozzle openings by using a photolithography technique to execute exposure and development or carrying out plasma etching. However, in view of the recently growing demand for prints with photographic image quality, it is expected that ink droplets will need to impact sheets more and more precisely. Accordingly, in view of the machining precision for the nozzles 3001 and the alignment precision for the heaters, it is more advantageous to collectively form the nozzles 3001 on the substrate 3005 using the photolithography technique as in the above second method.

In a side shooter type ink jet print head constructed as described above, ink is held with forming meniscus in the vicinity of the plurality of nozzles. Then, the heating resistance elements 3002 are selectively driven in accordance with image data so that the resulting thermal energy is used to rapidly heat ink on a heated surface to cause film boiling, thereby ejecting the ink using the force of the resultant bubbles.

If the resistance values of the heating resistance elements 3002 arranged on the substrate 3005, described above, vary among print heads, providing uniform drive power to all print heads varies the amount of heat generated among the heating resistance elements 3002 owing to the variation in the resistance values, thus leading to differences in ink bubbling phenomenon among the print heads. For example, if the drive power is set at a small value relative to a required resistance value, the ink is unstably ejected, i.e., the amount of ink ejected is not uniform. In contrast, if the drive power is set at a large value, an unnecessarily large amount of power is supplied to the heating resistance elements to reduce the lives of these elements or the print head, thereby possibly degrading the reliability of the print head. Accordingly, it is very desirable to solve the above problems by measuring the resistance values of the heating resistance elements 3002 of each head using a certain method to provide appropriate power for these resistance values.

However, if an attempt is made to directly measure the heating resistance elements 3002 of each head, the total resistance value, i.e. the resistance values of each heating resistance element 3002 and functional elements electrically connected thereto, is measured, thereby hindering the resistance value of only the heating resistance element 3002 to be accurately measured.

Thus, as disclosed in the applicant's Japanese Patent Application Laid-open No. 7-76077 (1995), the following methods have been employed; a method using a head construction having measuring resistance elements which are electrically independent of heating resistance elements and functional elements and which have larger resistance values than the heating resistance elements, the method comprising the steps of measuring the resistance values of the measuring resistance elements, formed similarly to the heating resistance elements and determining a sheet resistance from the resistance values of the measuring resistance elements to estimate the resistance values of the heating resistance elements, and a method of actually performing a printing operation to measure ejection threshold values. The ink can be stably ejected by setting appropriate drive power for the resistance values of the heating resistors of each head.

If one of these methods is used, i.e. the measuring resistance elements are used, it is most common to classify the heads into a number of ranks on the basis of the estimated resistance values so as to avoid problems due to differences in ink bubbling phenomenon as described above, and to set appropriate drive power, for example, an appropriate drive signal pulse width, for each rank.

As an example of such ranking, FIG. 2 shows data on a head in which power transistors for driving the heating resistance elements are of an n-MOS type and the heaters are composed of TaN. The other conditions include a heater size of 24×24 μm, a sheet resistance of 50 Ω/□±10%, a wiring resistance of 8 Ω, a power transistor ON resistance of 17 Ω±40%, a drive power of 11 V, and a correction value (K value, described later) of 1.20 for a predetermined margin. As shown in FIG. 2, the pulse width set depending on the varying resistance value of the head is between 0.82 and 1.29 μsec, and the difference between the maximum and minimum values of the pulse width is 0.47 μsec.

Further, the pulse width set for each rank is the appropriate value set per nozzle at room temperature, so that the pulse width is modulated in order to negate the adverse effects of the temperature of the head as being driven, the density of print patterns (the number of nozzles through which ink is simultaneously ejected), or the like (this modulation will hereinafter be referred to as "PWM control" or "K value control"). Specifically, control is provided such that the pulse width is reduced if the temperature increases during a head driving operation, and is increased if the density of print patterns increases.

In the recent years, ink jet printing apparatuses have advanced rapidly in the market, thereby requiring the definition of print images to be further improved. Thus, it is desirable to increase the resistances of the heating resistance elements in order to allow smaller ink droplets to be efficiently ejected. Presently, heating resistors for thermal ink jet are composed of HfB, TaN, TaAl, TaSiN, or the like, and no other high-resistance material has been discovered yet.

It is thus contemplated that the resistances of the heating resistance elements may be increased by reducing the thickness of each heater or improving its shape to substantially increase the number of sheets. However, in this case, manufacturing constraints become more severe to increase the variation in resistance value. Thus, with the above-described conventional method, print heads with a rank "min." having the minimum resistance value within a tolerance range have an excessively small pulse width, whereas print heads with a rank "max." having the maximum resistance value within the tolerance range have an excessively large pulse width. Further, even if the pulse width modulation control is designed so as to properly correspond to each rank at the room temperature (for example, between 15 and 35° C.), it may be very difficult to design the PWM control or K value control in accordance with a variation in temperature or print pattern density. To avoid this problem, it is contemplated that the tolerances may be reduced so that heads, the resistance value of which deviate from the tolerance, are considered to be defective. However, this may reduce the yield of manufactured print heads to sharply increase the costs thereof, so that this method is not a realistic solution.

SUMMARY OF THE INVENTION

It is an object of the present invention to deal with an increase in variation in resistance value without increasing costs by allowing smaller ink droplets to be efficiently ejected, the increase resulting from a means for increasing the resistances of heating resistance elements comprises reducing the thickness of heaters, improving the shape thereof to substantially increase the number of sheets, or the like.

To attain this object, the present invention provides a method of driving and controlling an ink jet print head used to print a print medium by ejecting ink therefrom, the method being characterized in that a voltage of a drive signal input to the ink jet print head is variably set in accordance with information on threshold electric energy with which ink is ejected from the ink jet print head.

Here, as the threshold electric energy of the ink jet print head decreases, a lower voltage is set for the drive signal.

And in accordance with information on the threshold electric energy of the ink jet print head, a drive signal is provided to make uniform heat flux from the heater of the ink jet print head to the ink in order to provide a uniform pulse width.

And in accordance with information on the threshold electric energy of the ink jet print head, the voltage of a drive signal to the ink jet print head is variably set in order to provide a uniform pulse width.

Further, the drive signal is shaped like a pulse, and a pulse width thereof can be modulated on the basis of conditions used to drive the ink jet print head.

Here, the conditions used to drive the ink jet print head include at least one of temperature and print density of the ink jet print head.

As the voltage decreases, the pulse width is less significantly modulated on the basis of the conditions used to drive the ink jet print head.

In the above aspect, the ink print head has a plurality of nozzles through which ink is ejected and a plurality of elements generating energy that allows the ink to be ejected through the plurality of nozzles, wherein the threshold electric energy has a value based on minimum electric energy input to the plurality of elements to allow the ink to be ejected through the plurality of nozzles.

Alternatively, the ink print head may have a plurality of nozzles through which ink is ejected and a plurality of elements generating energy that allows the ink to be ejected through the plurality of nozzles, wherein the threshold electric energy has a value based on maximum electric energy input to the plurality of elements to allow the ink to be ejected through the plurality of nozzles.

Furthermore, in the above aspect, information on the threshold electric energy is a numerical value based on a value previously measured for the ink jet print head and stored in storage means of the ink jet print head so that the voltage of the drive signal can be variably set in accordance with this information.

Moreover, the ink jet print head has elements that generate, in response to the drive signal, thermal energy that causes film boiling in the ink, as energy utilized to cause the ink to be ejected.

Further, the present invention provides an ink jet print head used to print a print medium by ejecting ink therefrom, the print head being characterized by comprising storage means for storing information on threshold electric energy with which ink is ejected in order to receive a variable setting for a voltage of an input drive signal.

Here, the storage means is a fuse ROM or an EEPROM.

Further, the ink jet print head has elements that generate, in response to the drive signal, thermal energy that causes film boiling in the ink, as energy utilized to cause the ink to be ejected.

Furthermore, the present invention provides an ink jet printing apparatus that performs a printing operation using an ink jet print head of one of the above forms, the apparatus being characterized by comprising control means for variably setting a voltage of a drive signal input to the ink jet print head in accordance with information on threshold electric energy presented by the ink jet print head.

Here, the control means can set a lower voltage for the drive signal as the threshold electric energy of the ink jet print head decreases.

Further, the drive signal is shaped like a pulse, and the control means can have means for further modulating a pulse width of the signal in accordance with conditions used to drive the ink jet print head.

Here, the conditions used to drive the ink jet print head include at least one of temperature and print density of the ink jet print head.

The modulating means can less significantly modulate the pulse width based on the conditions used to drive the ink jet print head as the above voltage decreases.

In the above-described ink jet printing apparatus, the ink jet print head has a plurality of nozzles through which ink is ejected and a plurality of elements generating energy that allows the ink to be ejected through the plurality of nozzles, wherein the threshold electric energy has a value based on minimum electric energy input to the plurality of elements to allow the ink to be ejected through the plurality of nozzles.

Alternatively, the ink print head may have a plurality of nozzles through which ink is ejected and a plurality of elements generating energy that allows the ink to be ejected through the plurality of nozzles, wherein the threshold electric energy has a value based on maximum electric energy input to the plurality of elements to allow the ink to be ejected through the plurality of nozzles.

Furthermore, information on the threshold electric energy is a numerical value based on a value previously measured for the ink jet print head and stored in storage means of the ink jet print head.

A method of driving and controlling an ink jet print head used to print a print medium by ejecting ink therefrom, wherein in accordance with information on threshold electric energy and head temperature with which ink is ejected from the ink jet print head, a pulse width of a drive signal is variably set to make uniform the gradient of the temperature of a heater surface with respect to time.

In this specification, the word "print" (or "record") refers to not only forming significant information, such as characters and figures, but also forming images, designs or patterns on printing medium and processing media, whether the information is significant or insignificant or whether it is visible so as to be perceived by humans.

The word "print medium" or "print sheet" includes not only paper used in common printing apparatus, but cloth, plastic films, metal plates, glass, ceramics, wood, leather or any other material that can receive ink.

Further, the word "ink" (or "liquid") should be interpreted in its broad sense as with the word "print" and refers to liquid that is applied to the printing medium to form images, designs or patterns or to process the printing medium or process ink.

Further, the word "nozzle" collectively refers to nozzles and liquid passages that are in communication with the nozzles as well as elements that generate energy utilized to eject ink, unless otherwise specified.

As described above, the present invention provides, for example, an ink jet print head based on a thermal ink jet system, the print head using heating resistance elements that generate heat in response to electric conduction so that growth and contraction of bubbles is utilized to eject ink through nozzles, a setting for a pulse voltage is essentially varied depending on the ejection threshold energy of the head to deal with an increase in variation in resistance value which may occur if a means for reducing the thickness of heaters, improving the shape thereof to substantially increase the number of sheets, or the like. Accordingly, optimum drive power conditions can be reasonably designed to deal with a range of resistance value varying among heads owing to differences among manufactured print heads. Thus, smaller ink droplets can be efficiently ejected without increasing costs to cope with an increase in differences among manufactured heads.

The above and other objects, effects, features and advantages of the present invention will become more apparent from the following description of embodiments thereof taken in conjunction with the accompanying drawings.

BRIEF DESCRIPTION OF THE DRAWINGS

FIG. 2 is a diagram useful in describing examples of drive conditions for conventional print heads dependent on the ranks thereof;

FIG. 11 is a diagram useful in describing inconveniences that may occur if drive conditions are applied to a print head having the print element substrate shown in FIGS. 8A and 8B, depending on the rank of the print head;

FIG. 12 is a diagram useful in describing drive conditions according to an embodiment of the present invention, which conditions can be applied to the print head having the print element substrate shown in FIGS. 8A and 8B;

FIG. 13 is a diagram useful in describing drive conditions according to another embodiment of the present invention which conditions can be applied to the print head having the print element substrate shown in FIGS. 8A and 8B.

DETAILED DESCRIPTION OF PREFERRED EMBODIMENTS

The present invention will be described below in detail with reference to the drawings.

1. Apparatus Body

Figure 3:
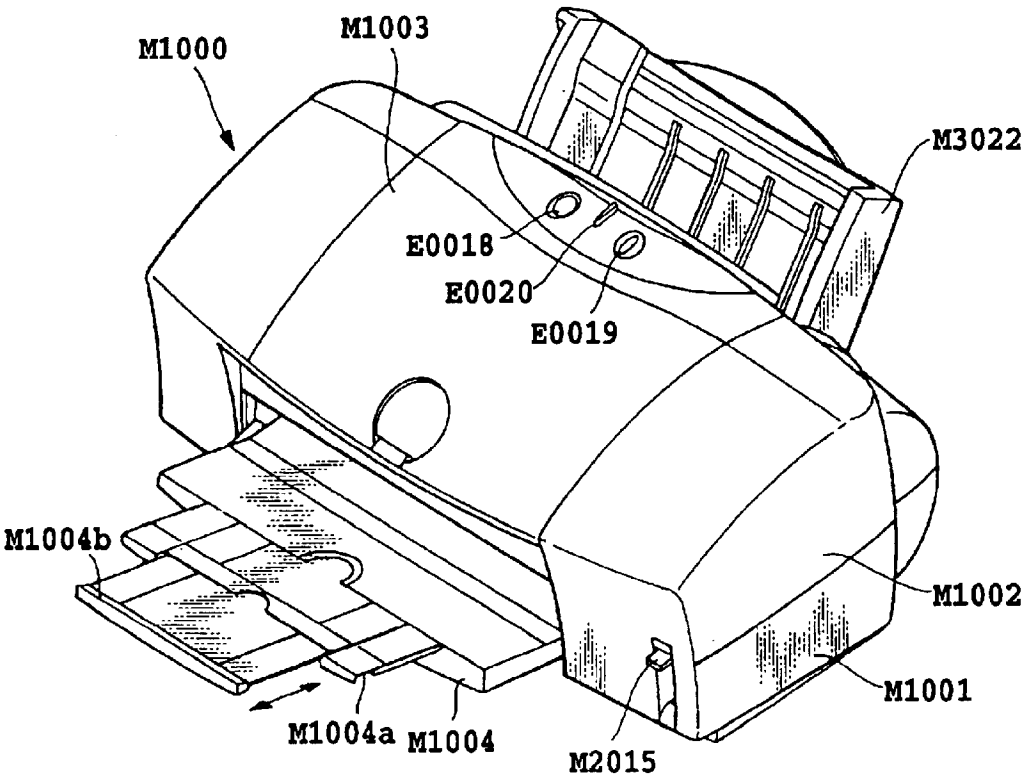
FIG. 3 is a perspective view showing the external construction of an ink jet printing apparatus according to an embodiment of the present invention.
Figure 4:
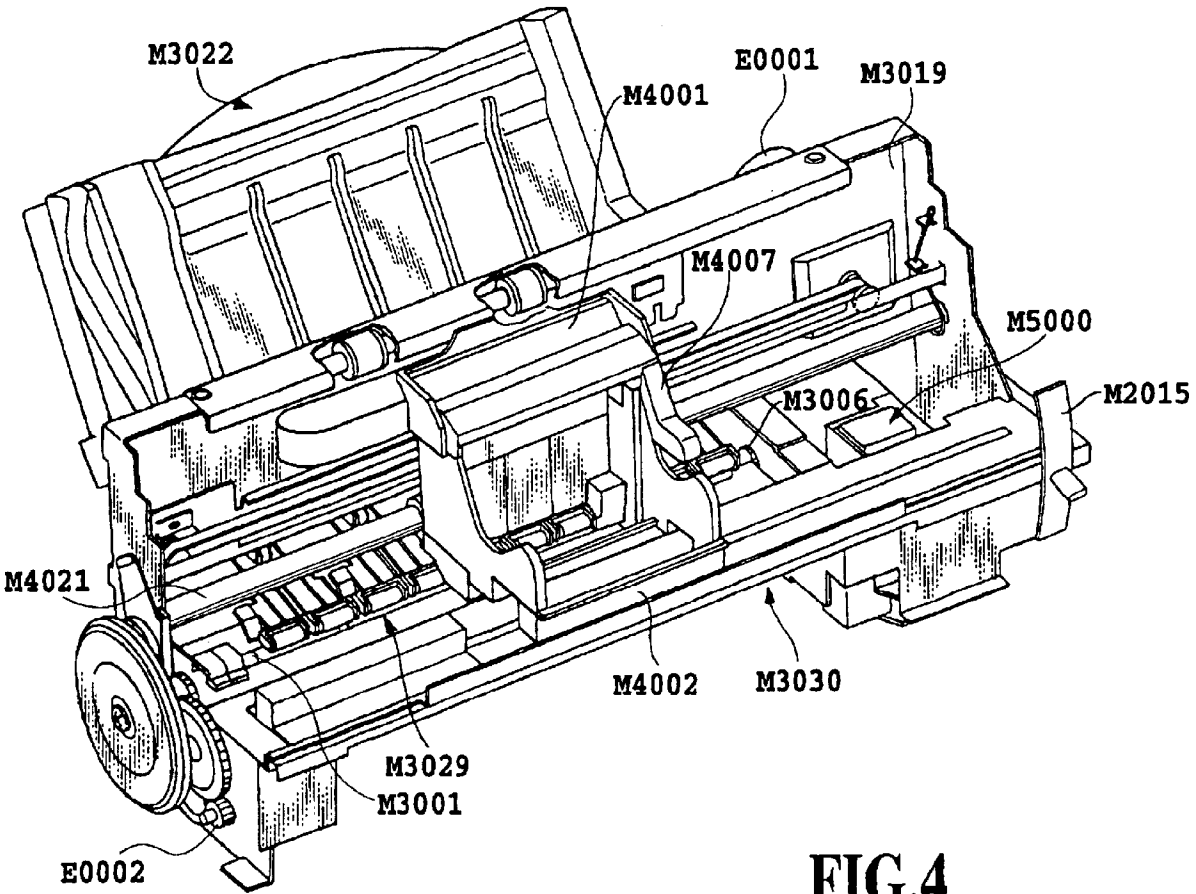
FIG. 4 is a perspective view showing the printer of FIG. 3 with an enclosure member removed.

FIGS. 3 and 4 show an outline construction of a printing apparatus using an ink jet printing system. In FIG. 3, a housing of a printing apparatus body M1000 of the printing apparatus according to this embodiment has an enclosure member, including a lower case M1001, an upper case M1002, an access cover M1003 and a discharge tray M1004, and a chassis M3019 (see FIG. 4) accommodated in the enclosure member.

The chassis M3019 is made of a plurality of plate-like metal members with a predetermined rigidity to form a skeleton of the printing apparatus and holds various printing operation mechanisms described later.

The lower case M1001 forms roughly a lower half of the housing of the printing apparatus body M1000 and the upper case M1002 forms roughly an upper half of the printing apparatus body M1000. These upper and lower cases, when combined, form a hollow structure having an accommodation space therein to accommodate various mechanisms described later. The printing apparatus body M1000 has an opening in its top portion and front portion.

The discharge tray M1004 has one end portion thereof rotatably supported on the lower case M1001. The discharge tray M1004, when rotated, opens or closes an opening formed in the front portion of the lower case M1001. When a print operation is to be performed, the discharge tray M1004 is rotated forwardly to open the opening so that printed sheets can be discharged and successively stacked. The discharge tray M1004 accommodates two auxiliary trays M1004*a*, M1004*b*. These auxiliary trays can be drawn out forwardly as required to expand or reduce the paper support area in three steps.

The access cover M1003 has one end portion thereof rotatably supported on the upper case M1002 and opens or closes an opening formed in the upper surface of the upper case M1002. By opening the access cover M1003, a print head cartridge H1000 or an ink tank H1900 installed in the body can be replaced. When the access cover M1003 is opened or closed, a projection formed at the back of the access cover, not shown here, pivots a cover open/close lever. Detecting the pivotal position of the lever as by a micro-switch and so on can determine whether the access cover is open or closed.

At the upper rear surface of the upper case M1002, a power key E0018 and a resume key E0019 are provided so as to be pressed, and an LED E0020 is also provided. When the power key E0018 is pressed, the LED E0020 lights up indicating to an operator that the apparatus is ready to print. The LED E0020 has a variety of display functions, such as alerting the operator to printing apparatus troubles as by changing its blinking intervals and color. Further, a buzzer E0021 (FIG. 9) may be sounded. When the trouble is eliminated, the resume key E0019 is pressed to resume the printing.

2. Printing Operation Mechanism

Next, a printing operation mechanism installed and held in the printing apparatus body M1000 according to this embodiment will be explained.

The printing operation mechanism in this embodiment comprises; an automatic sheet feed unit M3022 to automatically feed a print sheet into the printing apparatus body; a sheet transport unit M3029 to guide the print sheets, fed one at a time from the automatic sheet feed unit, to a predetermined print position and to guide the print sheet from the print position to a discharge unit M3030; a print unit to perform a desired printing operation on the print sheet carried to the print position; and a recovery unit M5000 to execute a recover process for the print unit and others.

Here, the print unit will be described. The print unit comprises a carriage M4001 movably supported on a carriage shaft M4021 and a print head cartridge H1000 removably mounted on the carriage M4001.

Figure 5:
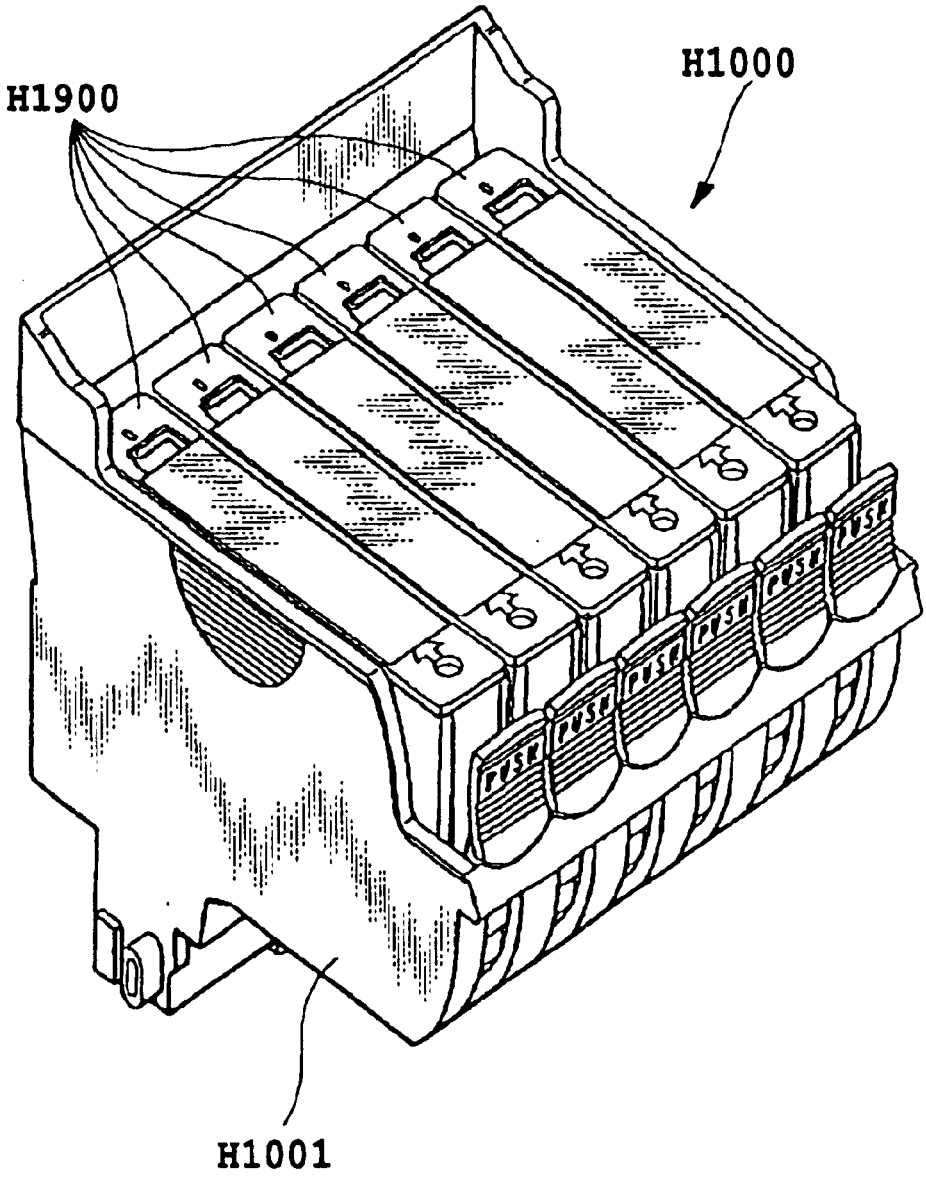
FIG. 5 is a perspective view showing how a head cartridge for use in an embodiment of the present invention has been assembled.
Figure 6:
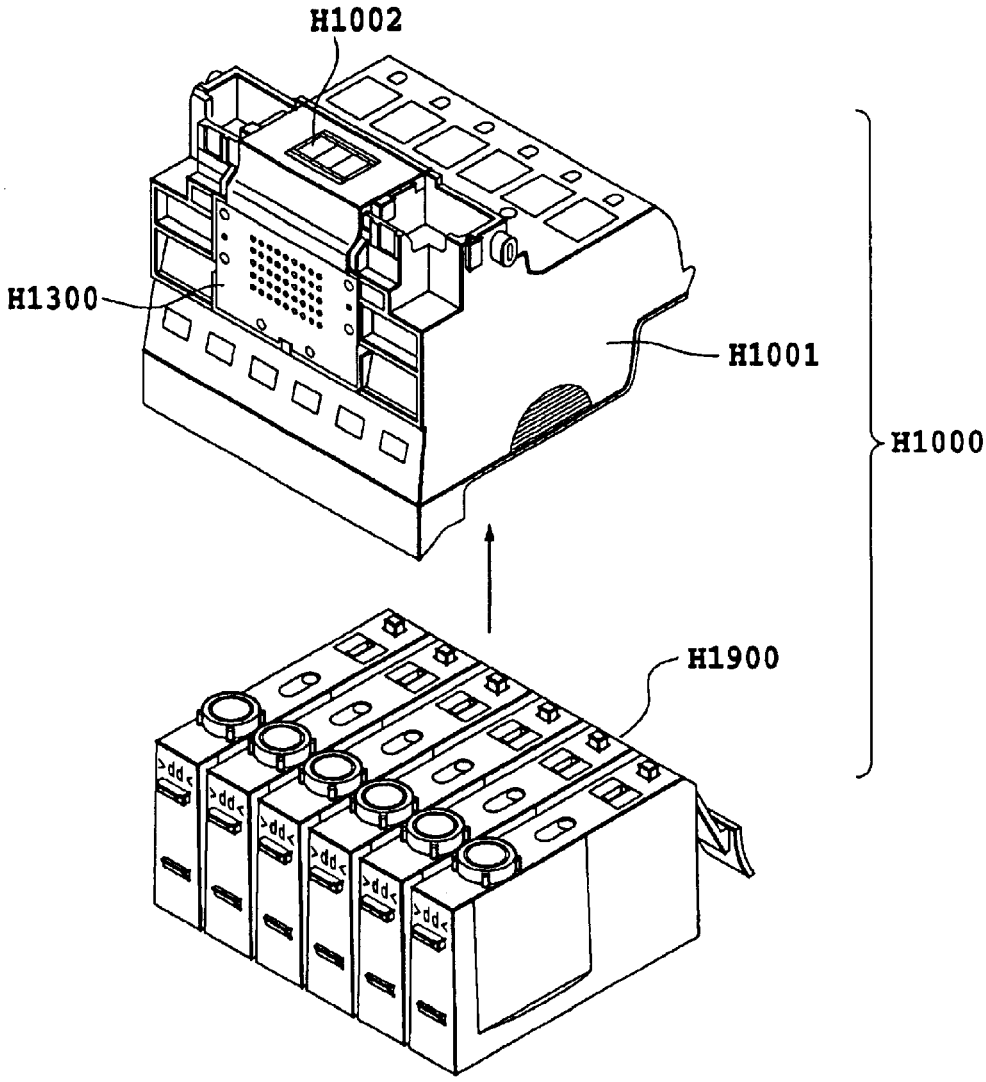
FIG. 6 is a perspective view inversely showing FIG. 5 in which ink tanks in FIG. 5 have been removed from a head cartridge main body.

FIGS. 5 and 6 show an example of the construction of the print head cartridge H1000. FIG. 5 is a perspective view showing that ink tanks H1900 storing ink are mounted on a head cartridge body H1001, FIG. 6 is a perspective view inversely showing FIG. 5, in which the ink tanks H1900 have been removed from the head cartridge body H1001. In this example, the head cartridge body H1001 is removably installed on the carriage M4001, described later.

The ink tank for this print head cartridge H1000 shown in the figures consists of separate ink tanks H1900 of, for example, black, light cyan, light magenta, cyan, magenta and yellow to enable color printing with as high an image quality as a photograph. These individual ink tanks are removably mounted to the print head H1001.

Figure 7:
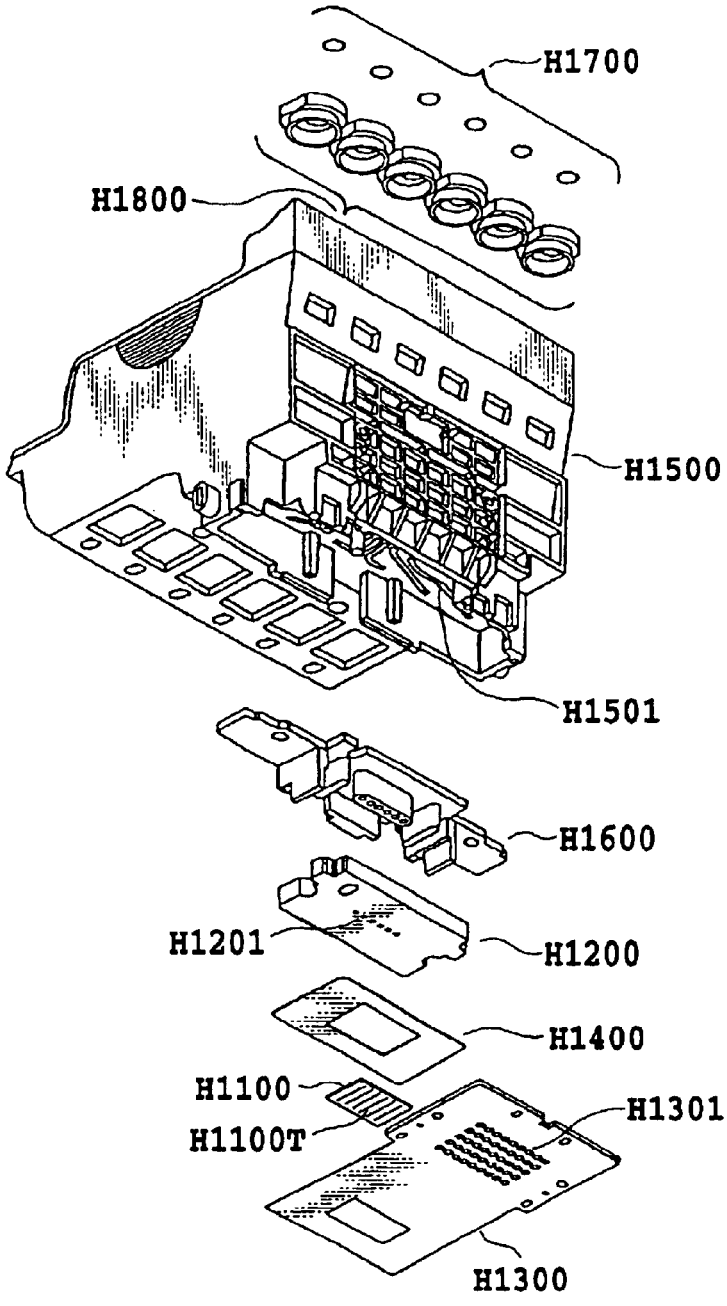
FIG. 7 is an exploded perspective view of the head cartridge in FIG. 5.

FIG. 7 is a broken perspective view of the head cartridge body H1001. The head cartridge body H1001 in this example comprises a print element substrate H1100, a first plate H1200, an electric wiring board H1300, a second plate H1400, a tank holder H1500, a flow passage forming member H1600, a filter H1700 and a seal rubber H1800.

Figure 1:
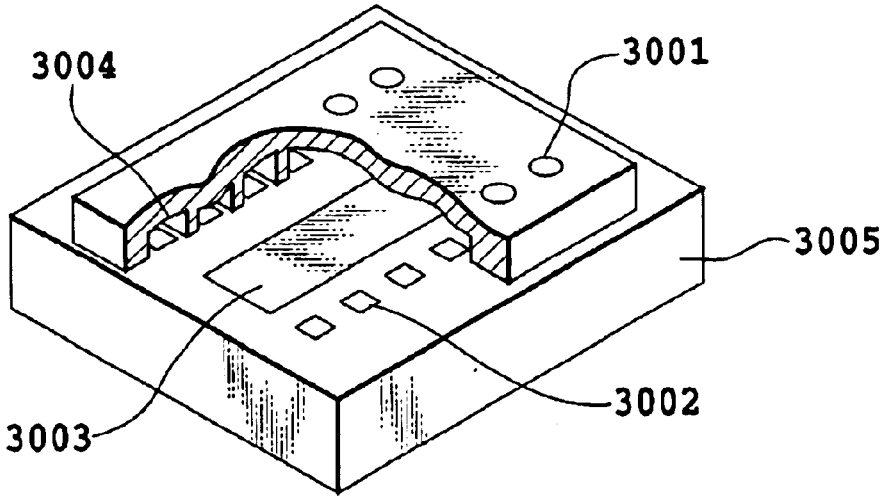
FIG. 1 is a perspective view of an example of the construction of what is called a side shooter type base for use in an ink jet print head.

The print element substrate H1100 has a construction equivalent to that of the side shooter type print head shown in FIG. 1, and has formed in one of its surfaces, by the film deposition technology, a plurality of print elements for ejecting ink and electric wires, such as aluminum, for supplying electricity to individual print elements. A plurality of ink passages and a plurality of nozzles H1100T, both corresponding to the print elements, are also formed by the photolithography technology. In the back of the print element substrate H1100, there are formed ink supply ports for supplying ink to the plurality of ink passages.

Figure 8A:
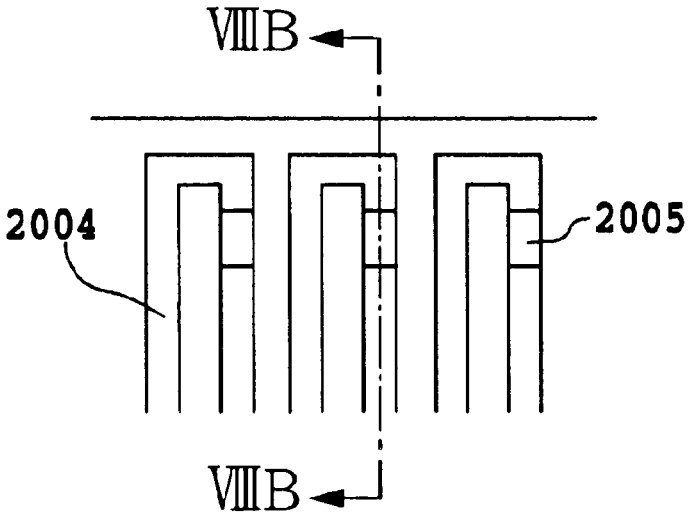
FIG. 8A is a schematic plan view showing the construction of print elements and electric wires on a print element substrate in FIG. 7.
Figure 8B:
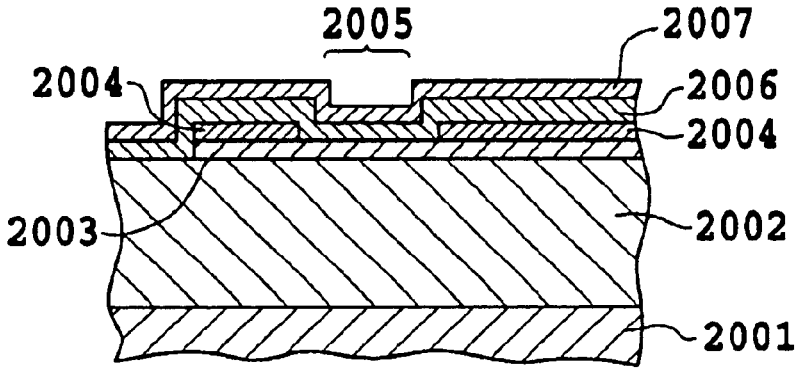
FIG. 8B is a schematic sectional view taken along line VIIIB—VIIIB in FIG. 8A.

FIG. 8A is a schematic plan view showing the construction of print elements and electrode wiring on the print element substrate H1100, and FIG. 8B is a partial sectional view taken along line VIIIB—VIIIB. To produce the print element substrate H1100, a silicon substrate or a silicon substrate with a driving IC already built thereinto is used. With a silicon substrate, a heat storage layer consisting of $SiO_2$ is formed by a thermal oxidation process, a sputtering process, or a CVD process. Also with a silicon substrate with an IC built thereinto, a heat storage layer consisting of $SiO_2$ is formed during its manufacture process. In FIG. 8B, reference numeral 2001 corresponds to the heat storage layer, having a thickness of 2 $\mu$m.

Next, a first Al layer (not shown) as common electrode wiring is formed by the sputtering process so as to have a thickness of 0.55 $\mu$m, then a wiring pattern is formed using a photolithography process, and subsequently etching is carried out using a reactive ion etching process. Then, an interlayer insulated film 2002 consisting of SiN, $SiO_2$, or the like is formed by the sputtering or CVD process so as to have a thickness of 1.4 $\mu$m. Then, a TaSiN layer 2003 as a heater and a second Al layer 2004 as electrode wiring are formed by the sputtering and reactive sputtering processes so as to have thicknesses of 0.018 and 0.2 $\mu$m, respectively. Next, a wiring pattern is formed using the photolithography process, and then the Al and TaSiN layers are successively etched using the reactive ion etching process. In order to use the photolithography process again to expose heating portions as shown by reference numeral 205 in FIGS. 8A and 8B, the Al layer is removed by a wet etching process. Then, an insulated film consisting of SiN, $SiO_2$, or the like as a first protective film 2006 is formed by the sputtering process, a plasma CVD process, or the like so as to have a thickness of 0.3 $\mu$m. A Ta layer as a second protective film 2007 is formed thereon so as to have a thickness of 0.23 $\mu$m, while executing a patterning process as required.

The thus produced print element substrate H1100 is securely bonded to the first plate H1200 which is formed with ink supply ports H1201 for supplying ink to the print element substrate H1100. The first plate H1200 is securely bonded with the second plate H1400 having an opening. The second plate H1400 holds the electric wiring board H1300 to electrically connect the electric wiring board H1300 with the print element substrate H1100. The electric wiring board H1300 essentially applies electric signals for ejecting ink to the print element substrate, and has electric wires associated with the print element substrate H1100 and external signal input/output terminals H1301 situated at electric wires' ends for receiving electric signals from the printing apparatus body. The external signal input/output terminals H1301 are positioned and fixed at the back of a tank holder H1500 described later.

The head cartridge body H1001 is equipped with a means for storing required information on the print element substrate H1100, i.e. information used to define drive conditions corresponding to the heating portion 2005 and presenting this information when mounted in the apparatus body. This means may be composed of, for example, a non-volatile memory such as an EEPROM or a fuse ROM which is mounted on the electric wiring substrate H1300. Further, the head cartridge body H1001 or the print element substrate H1100 may be provided with a temperature sensor for detecting temperature to present this information. Then, the presented information can be transmitted to a control section of the apparatus body via the external signal input/output terminals H1301.

On the other hand, the tank holder H1500 that removably holds the ink tanks H1900 is securely attached, as by ultrasonic fusing, to the flow passage forming member H1600 to form an ink passage H1501 from the ink tank H1900 to the first plate H1200. At the ink tank side end of the ink passage H1501 that engages with the ink tank H1900, a filter H1700 is provided to prevent entry of external dust. A seal rubber H1800 is provided at a portion where the filter H1700 engages the ink tank H1900, to prevent evaporation of the ink from the engagement portion.

As described above, the tank holder unit, which includes the tank holder H1500, the flow passage forming member H1600, the filter H1700 and the seal rubber H1800, and the print element unit, which includes the print element substrate H1100, the first plate H1200, the electric wiring board H1300 and the second plate H1400, are combined together as by adhesives to form the print head H1001.

Next, the carriage M4001 carrying the print head cartridge H1000 constructed as described above will be described with reference to FIG. 4 again.

As shown in FIG. 4, the carriage M4001 has a carriage cover M4002 for guiding the head cartridge H1001 to a predetermined mounting position on the carriage M4001, and a head set lever M4007 that engages and presses the tank holder H1500 of the head cartridge H1001 to set the head cartridge H1001 at a predetermined mounting position.

That is, the head set lever M4007 is provided at the upper part of the carriage M4001 so as to be pivotable about a head set lever shaft. There is a spring-loaded head set plate (not shown) at an engagement portion where the carriage M4001 engages the print head H1001. With this spring force, the head set lever M4007 presses against the print head H1001 to mount it on the carriage M4001.

At another engagement portion of the carriage M4001 with the print head H1001, there is provided a contact flexible printed cable (see FIG. 9; simply referred to as a contact FPC hereinafter) E0011 whose contact portion electrically contacts with a contact portion (external signal input terminals) H1301 provided in the print head H1001 to transfer various information for printing and supply electricity to the print head H1001.

Between the contact portion of the contact FPC E0011 and the carriage M4001 there is an elastic member (not shown), such as rubber. The elastic force of the elastic member and the pressing force of the head set lever spring ensure a reliable contact between the contact portion of the contact FPC E0011 and the carriage M4001. Further, the contact FPC E0011 is connected to a carriage substrate E0013 mounted at the back of the carriage M4001 (see FIG. 9).

4. Example Configuration of Electric Circuit of Printing Apparatus

Next, an electric circuit configuration in this embodiment of the invention will be explained.

Figure 9:
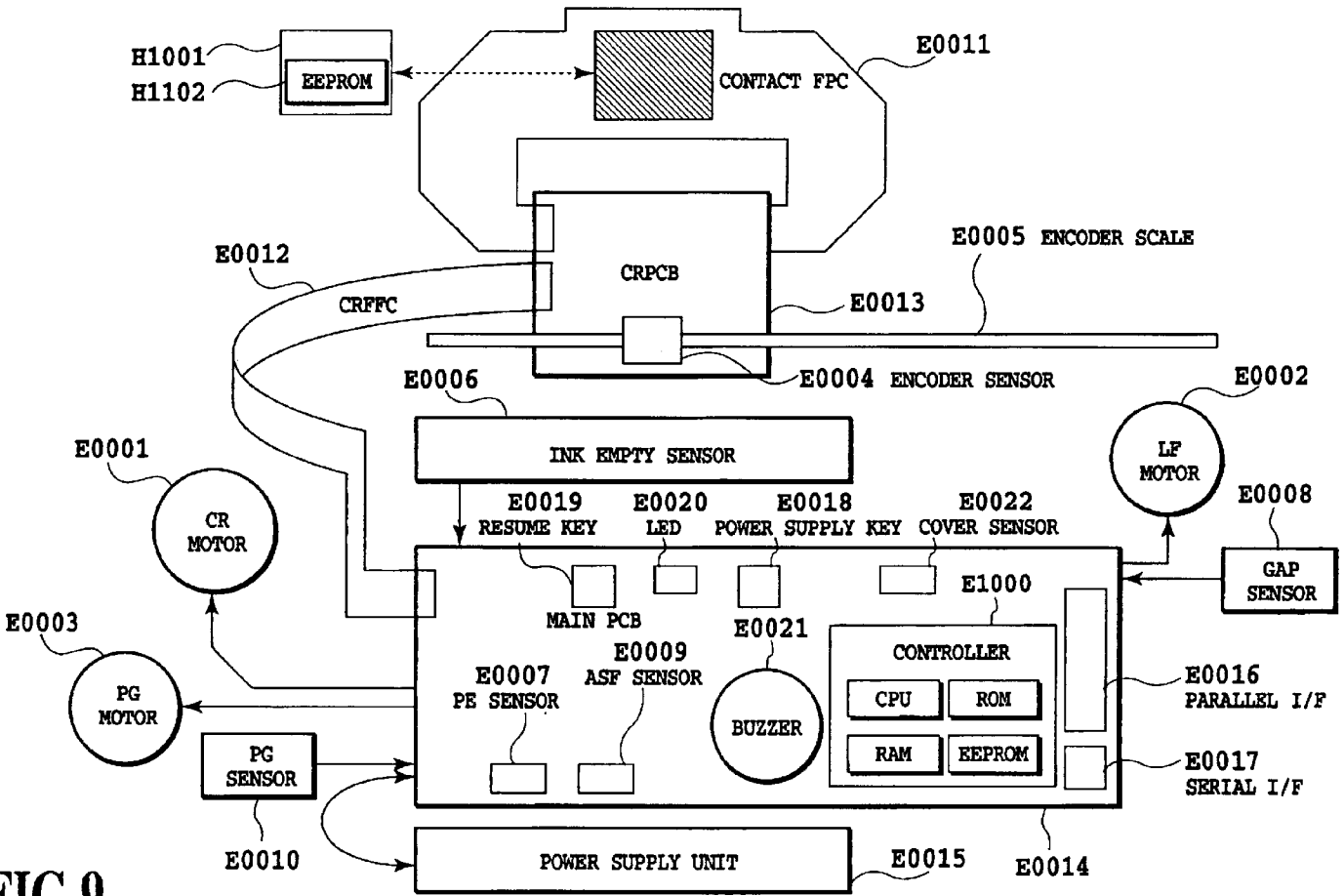
FIG. 9 is a block diagram schematically showing the entire construction of a control system of a printing apparatus according to an embodiment of the present invention.

FIG. 9 schematically shows an example of the overall configuration of the electric circuit in this embodiment.

The electric circuit in this embodiment comprises mainly a carriage substrate (CRPCB) E0013, a main PCB (printed circuit board) E0014 and a power supply unit E0015.

The power supply unit E0015 is connected to the main PCB E0014 to supply a variety of drive power. Further, the main PCB E0014 variably sets a pulse voltage applied to the head as described later.

The carriage substrate E0013 is a printed circuit board unit mounted on the carriage M4001 (FIG. 4) and functions as an interface for transferring signals to and from the print head through the contact FPC E0011. In addition, based on a pulse signal output from an encoder sensor E0004 as the carriage M4001 moves, the carriage substrate E0013 detects a change in the positional relation between an encoder scale E0005 and the encoder sensor E0004 and sends its output signal to the main PCB E0014 through a flexible flat cable (CRFFC) E0012. Further, the carriage substrate E0013 transmits drive condition definition information presented by the non-volatile memory (EEPROM) H1002 of the head cartridge body H1001, to the main PCB E0014 via the CRFFC E0012.

Furthermore, the main PCB E0014 is a printed circuit board unit that controls the operation of various parts of the ink jet printing apparatus in this embodiment, and has I/O ports for a paper end sensor (PE sensor) E0007 for detecting an end portion of a print medium, a sensor E0009 for detecting the operation of an ASF (Automatic Sheet Feeder), a sensor E0022 for detecting that the cover M1003 is opened or closed, a parallel interface (parallel I/F) E0016, a serial interface (Serial I/F) E0017, a resume key E0019, an LED E0020, a power key E0018 and a buzzer E0021, all the input ports being provided on the substrate. The main PCB E0014 is connected to and controls a motor (CR motor) E0001 that constitutes a drive source for moving the carriage M4001 in the main scan direction; a motor (LF motor) E0002 that constitutes a drive source for transporting the printing medium; and a motor (PG motor) E0003 that performs the functions of causing the print head to pivot and feeding printing media. The main PCB E0014 also has connection interfaces with an ink empty sensor E0006, a gap sensor E0008, a PG sensor E0010, the CRFFC E0012 and the power supply unit E0015.

Reference numeral E1000 denotes a controller mainly responsible for the control that must be executed by the main PCB E0014. The controller comprises a CPU that executes required process procedures, a ROM that stores fixed data such as programs which correspond to the process procedures, a RAM used to expand image data and to perform other operations, an EEPROM that holds required data even when the apparatus power supply is turned off and other elements.

4. Operation of Printing Apparatus

Figure 10:
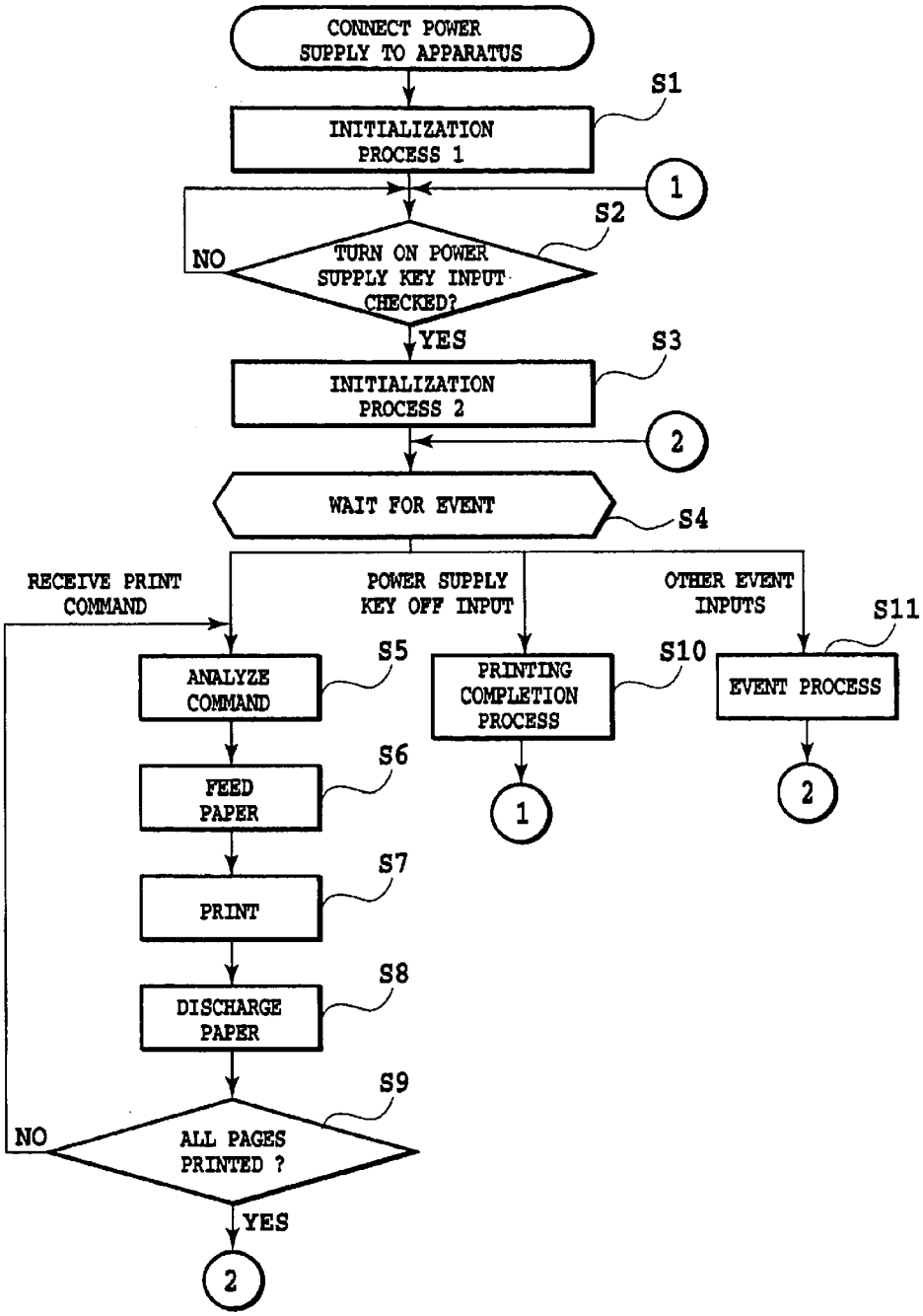
FIG. 10 is a flow chart showing an example of an operation of the printing apparatus using the control system in FIG. 9.

FIG. 10 is a flow chart showing an example of the operation of the ink jet print apparatus according to the embodiment of the present invention, which is constructed as described above.

When the printing apparatus body M1000 is connected to an AC power supply, a first initialization is performed at step S1. In this initialization process, the electric circuit system including the ROM and RAM in the apparatus is checked to confirm that the apparatus is electrically operable.

Next, step S2 checks if the power key E0018 on the upper case M1002 of the printing apparatus body M1000 is turned on. When it is decided that the power key E0018 is pressed, the processing moves to the next step S3 where a second initialization is performed.

In this second initialization, a check is made of various drive mechanisms and the print head of this apparatus. That is, various motors are initialized, and information presented by the head is read.

Next, steps S4 waits for an event. That is, this step monitors a demand event from the external I/F, a panel key event from the user operation and an internal control event and, when any of these events occurs, executes the corresponding processing.

When, for example, step S4 receives a print command event from the external I/F, the processing moves to step S5. When a power key event from the user operation occurs at step S4, the processing moves to step S10. If another event occurs at step S4, the processing moves to step S11.

Step S5 analyzes the print command from the external I/F, checks a specified paper type, paper size, print quality, paper feeding method and others, and stores data representing the check result into the RAM E2005 of the apparatus before proceeding to step S6.

Next, step S6 starts feeding the paper according to the paper feeding method specified by the step S5 until the paper is situated at the print start position. The processing moves to step S7.

At step S7 the printing operation is performed. In this printing operation, the print data sent from the external I/F is stored temporarily in the print buffer. Then, the CR motor E0001 is started to move the carriage M4001 in the main-scanning direction. At the same time, the print data stored in the print buffer E2014 is transferred to the print head H1001 to print one line. When one line of the print data has been printed, the LF motor E0002 is driven to rotate the LF roller M3001 to transport the paper in the sub-scanning direction. After this, the above operation is executed repetitively until one page of the print data from the external I/F is completely printed, at which time the processing moves to step S8, Further, during this printing operation, PWM control or K value control is executed to negate the adverse effects of the temperature of the head as being driven, the density of printed images, or the like.

At step S8, the LF motor E0002 is driven to rotate the paper discharge roller M2003 to feed the paper until it is decided that the paper is completely fed out of the apparatus, at which time the paper is completely discharged onto the paper discharge tray M1004.

Next at step S9, it is checked whether all the pages that need to be printed have been printed and if there are pages that remain to be printed, the processing returns to step S5 and the steps S5 to S9 are repeated. When all the pages that need to be printed have been printed, the print operation is ended and the processing moves to step S4 waiting for the next event.

Step S10 performs the printing termination processing to stop the operation of the apparatus. That is, to turn off various motors and print head, this step renders the apparatus ready to be cut off from power supply and then turns off power, before moving to step S4 waiting for the next event.

Step S11 performs other event processing. For example, this step executes a process corresponding to a recovery command from any of the various panel keys or external I/F and internal recovery events, or a required process associated with replacement of the head cartridge body H1001 or ink tank H1002. After the process has been finished, the printing apparatus operation moves to step S4, waiting for the next event.

5. Setting Drive Conditions for Print Head

The heater produced as described in FIGS. 8A and 8B and consisting of TaSiN has a resistivity of $360\times10^{-6}$ Ωcm and a sheet resistance of 200 Ω/□, and the sheet resistance varies within ±30% of this value. The variation in resistance value is three times as large as that in the prior art because the resistivity is increased not only by selecting the appropriate heater material but also by reducing the film thickness of the heater, so that the effects of an area with unstable film quality become marked during the initial period of film formation. The other conditions are the same as those described in the Prior Art section; the size of the heater is 24×24 μm, the wiring resistance is 8 Ω, the ON resistance of a power transistor is 17 Ω±40%, and the K value is 1.20.

FIG. 11 shows the case where for a head having heaters constructed in accordance with the specification described above, a conventional method is used to set drive power corresponding to a room temperature environment. As shown in this diagram, the pulse width, set depending on resistance values varying among heads, is between 1.03 and 1.88 μsec, and the range Δ is 0.85 μsec. This range is substantially larger than that shown in FIG. 2, i.e. the range Δ=0.47 μsec. for a pulse width of 0.82 to 1.29 μsec., thus making it very difficult to set the PWM control or K value control, described above.

On the other hand, in this embodiment, a setting for a pulse voltage is varied depending on the ejection threshold energy of the print head.

FIG. 12 shows the case where this method is used to set drive power corresponding to the room temperature environment. As shown in this diagram, the pulse voltage is set lower for heads with heaters having smaller resistance values and set higher for heads with heaters having larger resistance values, thereby enabling the drive power to be reasonably set for the entire range of resistance values, i.e., all ranks of heads. In this case, although the same pulse width is set for all ranks of heads, several levels of pulse widths may be set as long as the PWM control or K value control can be reasonably provided. Further, since the head ranks have different current values depending on the applied voltage, the level of corrections effected by the PWM control or K value control may be properly varied. For example, the level of modulation of the pulse width may be reduced consistently with the set pulse voltage.

Further, the inventors' detailed examinations indicate the following points: With heads A and B having different heater resistance value ranks and the same other structural conditions, the setting for the pulse width was varied depending on ejection threshold energy, and bubbles generated on the surfaces of heaters were observed. The heads A and B were compared together by using the same driving condition and using different pulse widths for a signal provided to the heaters of the head A and for a signal provided to the heaters of the head B. Then, it was found that the size (volume) of bubbles was larger with the larger pulse width, and the speed at which ink droplets were ejected was also faster with the larger pulse width.

On the other hand, it was found that if a difference in rank between the heads A and B is compensated for by varying the voltage, while using the same pulse width, ink is ejected with an equivalent bubble size (volume) and ejection speed.

This is because the work that bubbles execute on the ink during bubbling is dominated by heat flux (MW/m2) transmitted from the heaters to the ink. If both heads have the same heat flux, film boiling can be achieved in both heads using the same amount of ink, thereby providing both heads with equivalent ejection characteristics such as ejection speed and amount, mentioned above. Further, as is apparent from its unit, the heat flux corresponds to wattage, which contributes to bubbling per unit time and unit heater area and is dominated by the pulse width. Thus, by varying the voltage depending on the rank of the head, while using the same pulse with, heads with different heater resistance value ranks can be provided with equivalent heat fluxes and thus equivalent ejection characteristics.

If the voltage at the circuit in the head decreases owing to printing duty and when an attempt is made to compensate for this by modulating the pulse width, the insufficient amount of input energy must be compensated for, and the ejection characteristics may be consequently changed as described above. Thus, to compensate for a voltage drop without changing the ejection characteristics, it is desirable to adjust the amount of ink ejected by varying the driving voltage without varying the provided pulse width.

In this embodiment, the pulse width of a drive signal applied to the head is controlled to about 1 $\mu$sec., so that the heaters can rapidly generate heat to cause ink to bubble stably, thereby minimizing fluctuations. Further, this embodiment can accommodate a decrease in period of ejection through the nozzles to increase print speed and improve image quality.

The optimum drive conditions, which should be set as described above, can be measured during a shipment inspection step for the print head or head cartridge body H1001 and then written to the storage means (EEPROM H1102) of the head cartridge body H1001.

For example, these measurements can be carried out by sequentially applying a drive pulse while gradually reducing the voltage with an arbitrarily specified pulse width fixed, to determine a range of voltage values with which ink is appropriately ejected through a required number of a plurality of nozzles corresponding to a plurality of heating resistance elements or preferably all nozzles associated with a printing operation. Then, the maximum and minimum voltage values of this range are retained in the storage means, and the difference between the maximum and minimum values can be incorporated in the design as a margin.

In executing measurements by gradually reducing the pulse voltage, the number of steps and the amount of time required for the measurements can be reduced by setting, as a starting value, a value estimated by referencing a value for the measuring resistance element or fuse ROM provided on the print element substrate H1100, and determining, as a minimum value, a voltage value obtained immediately before ink is not appropriately ejected through the required number of the plurality of nozzles corresponding to the plurality of heating resistance elements or preferably all the nozzles associated with a printing operation.

Thus, the optimum drive pulse voltage is obtained by multiplying a voltage value obtained through the measurement step by an appropriate correction value (K value) corresponding to the above margin. Then, this drive pulse voltage is written to the storage means such as EEPROM H1102 so that when the head is mounted in the printing apparatus, the voltage value can be read by the printing apparatus to set an optimum drive pulse voltage for the mounted head. Consequently, during a printing operation, a pulse is applied under the appropriate drive conditions, and the PWM control or K value control can be properly executed to negate the adverse effects of the temperature of the head as being driven, the density of images to be printed, or the like.

Figure 14:
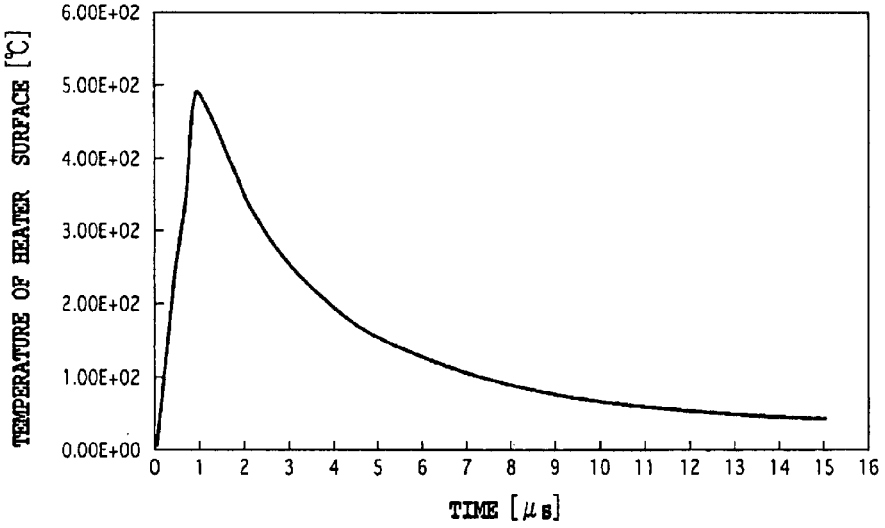
FIG. 14 is a diagram showing a temporal transition of heater surface temperature.

If the temperature of the head varies and the temperature of the ink on the heater surface also varies, then the pulse width may decrease with increasing head temperature if the same driving voltage is applied. This is because the temperature of the ink on the heater surface is already high prior to application of pulses, so that bubbling temperature is reached in a shorter time (see FIG. 14). Thus, to make the heat flux uniform relative to the temperature of the head, a variation in ink temperature must be considered for with the gradient of the temperature of the ink on the heater surface with respect to time kept constant regardless of the temperature of the head. That is, the pulse width must be reduced by a value corresponding to the time required for the temperature of the ink on the heater surface measured at room temperature to reach the value measured when the temperature of the head increases. That is, if a variation in temperature of the head is to be dealt with, then rather than varying the driving pulse voltage to make the pulse width uniform, the driving pulse width can be varied to make the heat flux uniform in order to stabilize the ejection characteristics.

Further, a combination of voltage modulation and pulse width modulation may be used so that to compensate for a voltage drop resulting from printing duty as described above, the drive signal is adjusted by giving priority to a variation in driving voltage without varying the pulse width and so that to compensate for a variation in temperature, the drive signal is adjusted by modulating the pulse width instead of the voltage.

6. Other Embodiments

The present invention is not limited to the above embodiment, but various changes may be made thereto as long as the objects thereof are attained.

FIG. 13 shows an example similar to the above-described embodiment except that different levels of pulse widths are set for the respective resistance values, i.e. the respective head ranks. This embodiment provides a smaller range within which the pulse voltage setting is varied than the embodiment described previously, thereby reducing loads on the printing apparatus.

Further, in the above-described embodiment, information such as the optimum drive pulse voltage is written to the EEPROM H1102 of the head cartridge body, but the optimum drive pulse voltage can be determined by the printing apparatus. That is, the head cartridge body stores information required to determine the optimum drive conditions (such as the rank of the head, the on resistance of the power transistor, and the margin), while the printing apparatus retains a table such as the one shown in FIG. 12 or 13, in the ROM or the like. Then, the optimum drive conditions can be set by referencing the above information presented when the head cartridge body is mounted in the printing apparatus.

Furthermore, the storage means storing information presented to the printing apparatus by the head cartridge body is not limited to the EEPROM as described above but may be a fuse ROM, a battery-backed RAM, DIP switches, or the like. Instead of such electric means, optical, magnetic, or mechanical means may be used as the storage means. Of course, a reading means of the printing apparatus can be constructed depending on the form of the storage means.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. A method of driving and controlling an ink jet print head used to print on a print medium by ejecting ink therefrom, wherein a voltage of a drive signal input to said ink jet print head is variably set in accordance with information on threshold electric energy with which ink is ejected from said ink jet print head and further wherein the drive signal is variably set in accordance with a condition at a time period during which said ink jet print head is driven, wherein a variable setting of the drive signal comprises modulation of the pulse width of the drive signal, and wherein when the set voltage of the drive signal is relatively low, the pulse width is less significantly modulated in accordance with the condition at the time period during which said ink jet print head is driven.

2. A method of driving and controlling an ink jet print head as claimed in claim 1, wherein as said threshold electric energy of said ink jet print head decreases, a lower voltage is set for said drive signal.

3. A method of driving and controlling an ink jet print head as claimed in claim 1, wherein in accordance with the information on said threshold electric energy of said ink jet print head, the drive signal is provided to make uniform heat flux from a heater of said ink jet print head to the ink in order to provide a uniform pulse width.

4. A method of driving and controlling an ink jet print head as claimed in claim 1, wherein in accordance with the information on said threshold electric energy of said ink jet print head, the voltage of the drive signal to said ink jet print head is variably set in order to provide a uniform pulse width.

5. A method of driving and controlling an ink jet print head as claimed in claim 1, wherein said drive signal is shaped like a pulse, and a pulse width thereof is modulated on the basis of conditions used to drive said ink jet print head.

6. A method of driving and controlling an ink jet print head as claimed in claim 5, wherein said conditions used to drive the ink jet print head include at least one of temperature of said ink jet print head and print density of said ink jet print head.

7. A method of driving and controlling an ink jet print head as claimed in claim 1, wherein said ink print head has a plurality of nozzles through which ink is ejected and a plurality of elements generating energy that causes the ink to be ejected through the plurality of nozzles, and said threshold electric energy has a value based on minimum electric energy input to said plurality of elements to allow the ink to be ejected through said plurality of nozzles.

8. A method of driving and controlling an ink jet print head as claimed in claim 1, wherein said ink print head has a plurality of nozzles through which ink is ejected and a plurality of elements generating energy that causes the ink to be ejected through the plurality of nozzles, and said threshold electric energy has a value based on maximum electric energy input to said plurality of elements to allow the ink to be ejected through said plurality of nozzles.

9. A method of driving and controlling an ink jet print head as claimed in claim 1, wherein the information on said threshold electric energy is a numerical value based on a value previously measured for said ink jet print head and stored in storage means of the ink jet print head so that the voltage of said drive signal can be variably set in accordance with the information.

10. A method of driving and controlling an ink jet print head as claimed in claim 1, wherein said ink jet print head has elements that generate, in response to said drive signal, thermal energy that causes film boiling in the ink, as energy utilized to cause the ink to be ejected.

11. A method of driving and controlling an ink jet print head as claimed in claim 1, wherein said modulation of the pulse width depends on a temperature change.

12. An ink jet printing apparatus that drives and controls an ink jet print head used to print on a print medium by ejecting ink therefrom, the apparatus comprising:

control means for variably setting a voltage of a drive signal input to said ink jet print head in accordance with information on threshold electric energy, with which ink is ejected from said ink jet print head, stored by said ink jet print head, wherein the drive signal is variably set in accordance with a condition at a time period during which said ink jet print head is driven, wherein a variable setting of the drive signal comprises modulation of the pulse width of the drive signal, and wherein when the set voltage of the drive signal is relatively low, the pulse width is less significantly modulated in accordance with the condition at the time period during which said ink jet print head is driven.

13. An ink jet printing apparatus as claimed in claim 12, wherein said control means sets a lower voltage for said drive signal as said threshold electric energy of said ink jet print head decreases.

14. An ink jet printing apparatus as claimed in claim 12, wherein said drive signal is shaped like a pulse, and said control means includes means for further modulating a pulse width of said drive signal in accordance with conditions used to drive said ink jet print head.

15. An ink jet printing apparatus as claimed in claim 14, wherein said conditions used to drive the ink jet print head include at least one of temperature and print density of said ink jet print head.

16. An ink jet printing apparatus as claimed in claim 12, wherein said ink print head has a plurality of nozzles through which ink is ejected and a plurality of elements generating energy that causes the ink to be ejected through the plurality of nozzles, and said threshold electric energy has a value based on minimum electric energy input to said plurality of elements to allow the ink to be ejected through said plurality of nozzles.

17. An ink jet printing apparatus as claimed in claim 12, wherein said ink print head has a plurality of nozzles through which ink is ejected and a plurality of elements generating energy that causes the ink to be ejected through the plurality of nozzles, wherein said threshold electric energy has a value based on maximum electric energy input to said plurality of elements to allow the ink to be ejected through said plurality of nozzles.

18. An ink jet printing apparatus as claimed in claim 12, wherein the information on said threshold electric energy is a numerical value based on a value previously measured for the ink jet print head and stored in storage means of said ink jet print head.

19. An ink jet printing apparatus as claimed in claim 12, wherein said modulation of the pulse width depends on a temperature change.

* * * * *

UNITED STATES PATENT AND TRADEMARK OFFICE

CERTIFICATE OF CORRECTION

PATENT NO. : 6,869,157 B2
DATED : March 22, 2005
INVENTOR(S) : Miyakoshi et al.

It is certified that error appears in the above-identified patent and that said Letters Patent is hereby corrected as shown below:

Column 2,
Line 44, “employed;” should read -- employed: --.

Column 4,
Lines 22 and 29, “ink” should read -- ink jet --.

Column 5,
Line 65, “like.” should read -- like is provided. --; and
Line 67, “value” should read -- values --.

Column 6,
Line 51, “invention” should read -- invention, --.

Column 14,
Line 19, “for” should be deleted.

Column 16,
Line 53, “causes” should read -- cause --.

Signed and Sealed this

Thirteenth Day of December, 2005

JON W. DUDAS
*Director of the United States Patent and Trademark Office*